US006945986B2

(12) United States Patent
Lope

(10) Patent No.: US 6,945,986 B2
(45) Date of Patent: Sep. 20, 2005

(54) EXTENDED SKULL AND POSTERIOR CERVICAL ADJUSTING DEVICE

(76) Inventor: Peter L. Lope, 131 Concord Dr., Freehold, NJ (US) 07728

( * ) Notice: Subject to any disclaimer, the term of this patent is extended or adjusted under 35 U.S.C. 154(b) by 230 days.

(21) Appl. No.: 10/236,231

(22) Filed: Sep. 6, 2002

(65) Prior Publication Data

US 2004/0049228 A1 Mar. 11, 2004

(51) Int. Cl.[7] ..... A61H 1/00
(52) U.S. Cl. ..... 606/240; 601/39; 128/845
(58) Field of Search ..... 601/39, 133, 135, 601/136, 137, 138, 24–26, 15, 115, 122, 124, 128, 132; 606/237, 238, 240; 128/845, 846, 869, 870; 602/18; 5/636, 637, 640

(56) References Cited

U.S. PATENT DOCUMENTS

| | | | | | |
|---|---|---|---|---|---|
| 2,386,134 | A | | 10/1945 | Mermis | 128/1 |
| 3,831,592 | A | * | 8/1974 | Lancellotti | 601/135 |
| 3,898,985 | A | * | 8/1975 | Butcher et al. | 601/146 |
| 3,901,222 | A | | 8/1975 | Muramatsu | 128/69 |
| 4,221,213 | A | | 9/1980 | Gregory et al. | 128/70 |
| 4,233,966 | A | * | 11/1980 | Takahashi | 601/134 |
| 4,445,504 | A | | 5/1984 | Barge | 128/70 |
| 4,520,798 | A | * | 6/1985 | Lewis | 601/134 |
| 4,711,230 | A | | 12/1987 | Berke et al. | 128/69 |
| 4,771,493 | A | * | 9/1988 | Park | 5/637 |
| 5,337,429 | A | * | 8/1994 | Tucker | 5/643 |
| 5,467,490 | A | | 11/1995 | Rice | 5/636 |
| 5,491,855 | A | | 2/1996 | Charles | 5/636 |
| 5,545,177 | A | * | 8/1996 | Coseo | 606/238 |
| 5,569,176 | A | | 10/1996 | Graham | 602/32 |
| 6,170,486 | B1 | * | 1/2001 | Islava | 128/869 |
| 6,375,631 | B2 | | 4/2002 | Harris et al. | 601/98 |
| 2001/0041851 | A1 | | 11/2001 | Peyton et al. | 601/133 |

* cited by examiner

*Primary Examiner*—Michael A. Brown
*Assistant Examiner*—Quang D. Thanh
(74) *Attorney, Agent, or Firm*—Duane Morris LLP

(57) ABSTRACT

A chiropractic adjusting device for facilitating adjustments of the skull and cervical regions of a patient, comprising a base having relatively parallel post members spaced apart and being capable of moving on the base to adjust the spacing between the members, the post members being capable of being positioned in a first mode and a second mode; wherein in the first mode, the post members support a cervical region for facilitating the chiropractic adjustment of the cervical region; and wherein in the second mode, the post members support an upper cervical region for facilitating the chiropractic adjustment of the skull region.

10 Claims, 6 Drawing Sheets

EXTENDED SKULL AND POSTERIOR CERVICAL ADJUSTING DEVICE

FIELD OF THE INVENTION

The present invention relates to a chiropractic adjusting device and more particularly, to a device for facilitating the performance of chiropractic adjustments to the skull and posterior cervical regions.

BACKGROUND OF THE INVENTION

Chiropractic adjustment devices and tables are well known in the art and are conventionally used in administering adjustments and treatments of vertebral areas that exhibit abnormal structures. Such devices are used in delivering specific, high-velocity applications of force in varying techniques, in which an objective is to precisely align the spinal components, as well as freeing immobile joints. Chiropractic tables, for example, typically have drop mechanisms that allow a section of the table to drop and thus, facilitate the osseous adjustment.

A significant number of such treatments involve serious whiplash injuries, when an individual's spine, usually their neck, buckles from being unexpectedly or suddenly thrown rapidly in one direction and then in the opposite direction. Whiplash damage may involve complex effects, including soft tissue injuries such as ligament damage. Similar injuries typically occur from other serious accidents, such as those related to certain sports activities.

Various prior art arrangements relating to the support and treatment of those neck and skull regions address primarily non-chiropractic applications. As an example, U.S. Pat. No. 2,386,134 discloses a portable, compact surgical fixture for engaging and supporting the head/neck of a patient, to facilitate nasal or throat surgery. U.S. Pat. No. 5,467,490 provides a neck cradle having a flexible bar member for supporting the neck, in order to relieve muscle tension in the neck and shoulders. U.S. Pat. No. 5,491,855 discloses an appliance for use in physical therapy, having a cervical tee which supports the neck to apply a continuous force at the head-neck interface.

Essentially, those and other relevant prior art arrangements provide support devices for surgery or physical therapy purposes. They do not mention the chiropractic correction of the skull and cervical regions. Nor do they address injuries resulting from whiplash.

Typical problems resulting from such injuries include fixation, reverse cervical curve and retro/antero listhesis (i.e. spinal malalignment due to one vertebra being positioned behind or in front of the other) of the C3 to C6 vertebrae, and flexion problems of the C0/C1 joint (i.e. the neck does not flex forward). It is often difficult to precisely and safely correct such damage by conventional chiropractic techniques. The present invention overcomes these problems by disclosing a device designed to aid in the chiropractic adjustment of such common and serious problems.

SUMMARY OF THE INVENTION

A chiropractic adjusting device for facilitating adjustments of the skull and cervical regions of a patient comprising a base having relatively parallel post members spaced apart and being capable of moving on the base to adjust the spacing between the members, the post members being capable of being positioned in a first mode and a second mode; wherein in the first mode, the post members support a cervical region for facilitating the chiropractic adjustment of the cervical region; and wherein in the second mode, the post members support an upper cervical region for facilitating the chiropractic adjustment of the skull region.

According to another aspect of the invention, in the first mode, a compliant strap connected between the post members supports the cervical region and in the second mode, contact elements positioned rotatably on the post members support the upper cervical region. It is embodied in another mode of the invention a method of facilitating chiropractic adjustments of the skull and cervical regions of a patient, including the steps of providing a base having relatively parallel post members spaced apart and being capable of moving on the base to adjust the spacing between the members, the post members being capable of being positioned in a first mode and a second mode, wherein in the first mode, the post members support a cervical region for facilitating the chiropractic adjustment of the cervical region, and wherein in the second mode, the post members support an upper cervical region for facilitating the chiropractic adjustment of the skull region; supporting the region to be supported by the post members; and performing a chiropractic adjustment on the region to be adjusted.

BRIEF DESCRIPTION OF THE FIGURES

For a fuller understanding of the invention, reference is made to the following description taken in connection with the accompanying drawings, in which.

DETAILED DESCRIPTION OF THE INVENTION

Figure 1:
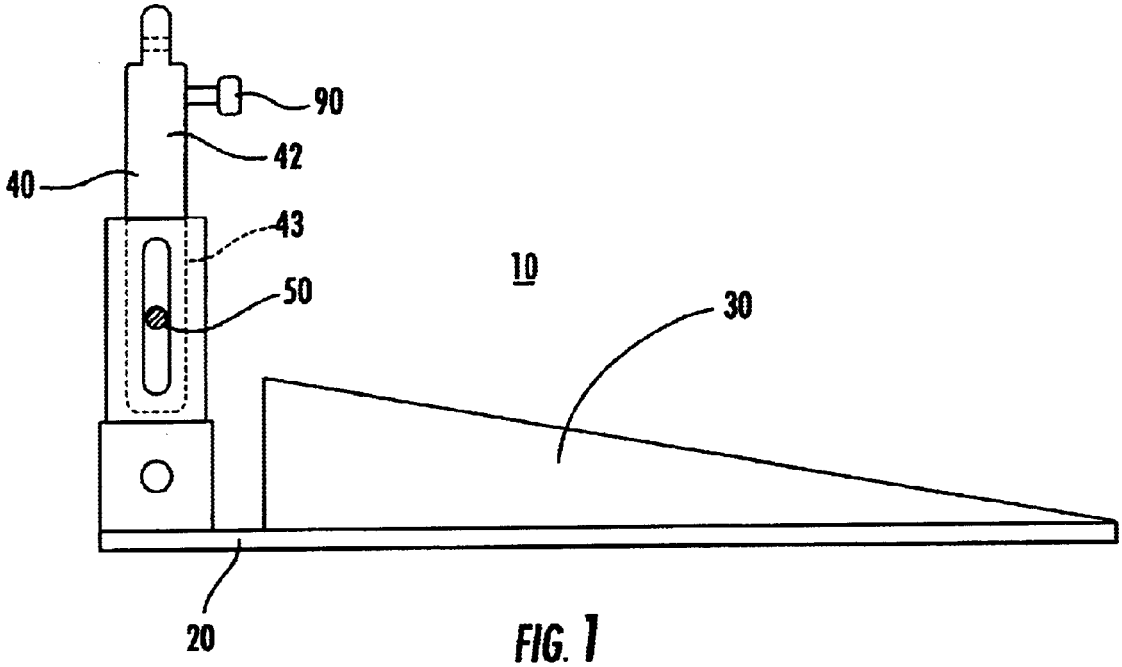
FIG. 1 is a side elevational view of an adjusting device made in accordance with the present invention.
Figure 2:
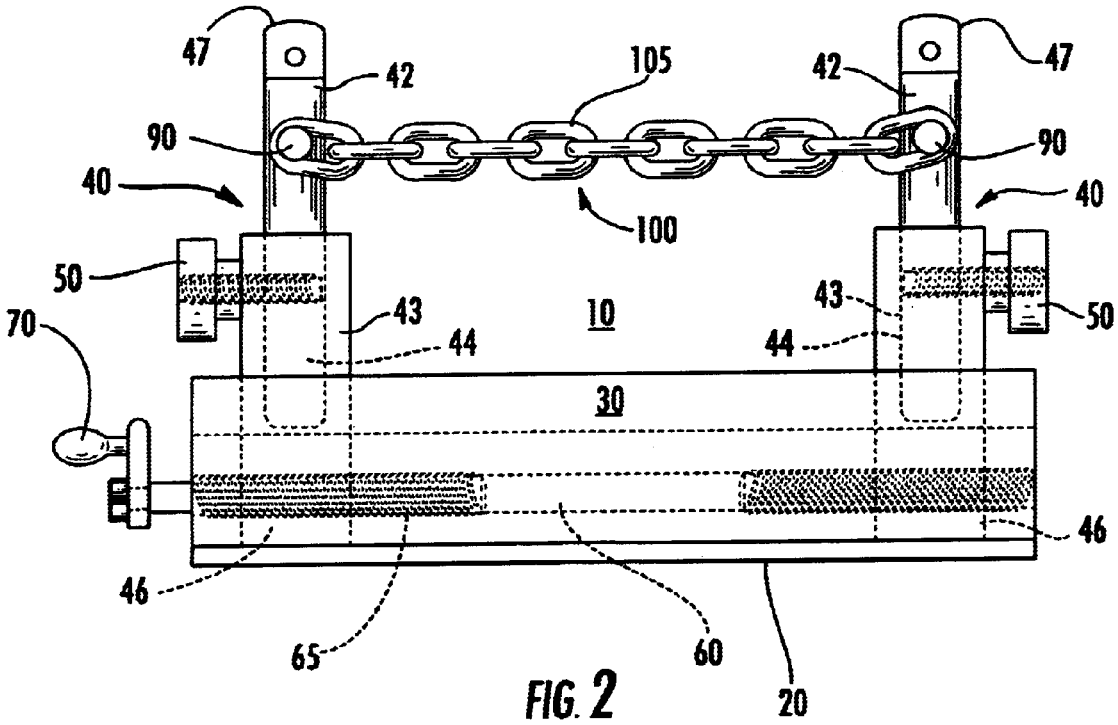
FIG. 2 is an elevational front view thereof.
Figure 3:
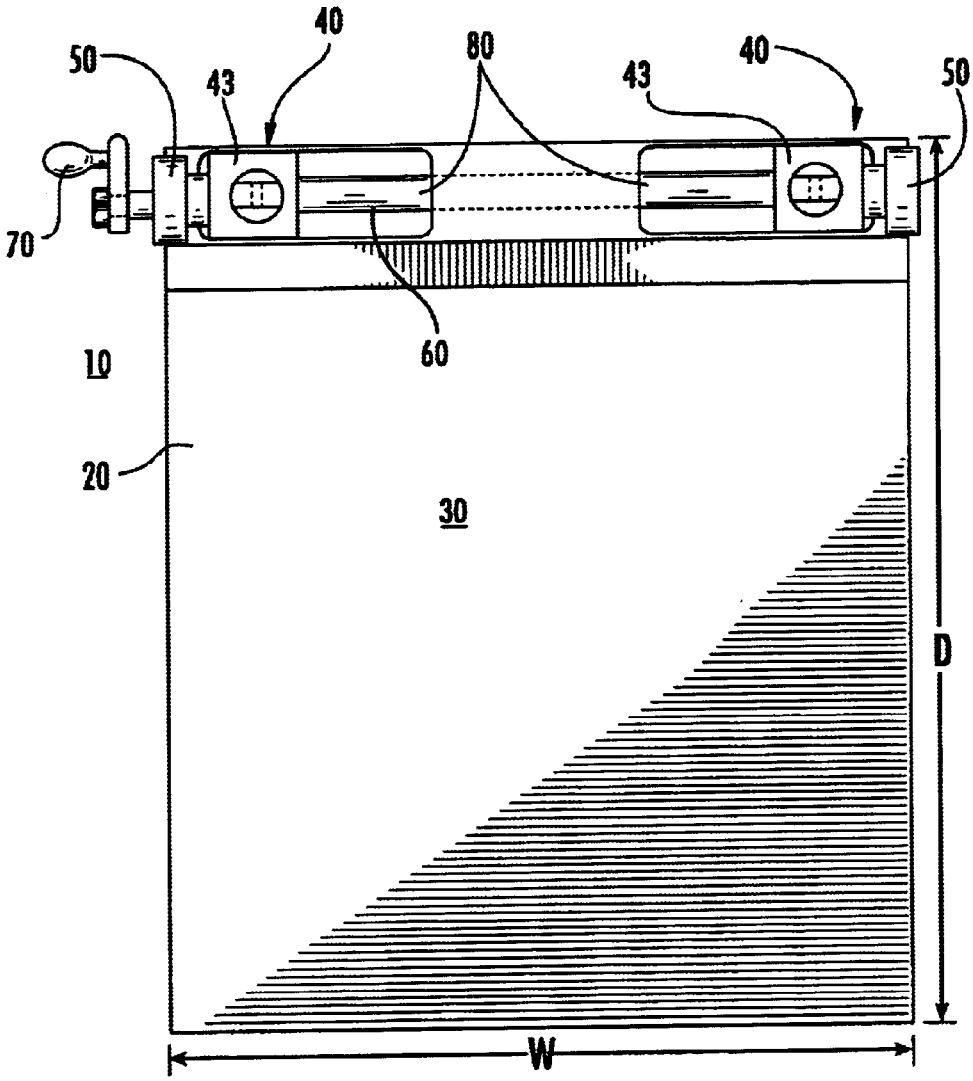
FIG. 3 is a top plan view thereof.

As illustrated in FIGS. 1–3, the invention relates to a portable chiropractic adjusting device for adjusting the skull and posterior neck regions of a patient. The device 10 comprises a base indicated at 20. The base is of a substantially rectangular shape and may have, for example, a width W of approximately 12½ inches and a depth D of approximately 10¾ inches. Other base dimensions or configurations as known in the art may also be used, to accommodate patients' varying proportions. A slanting resting cushion 30 is provided on the base for providing a resting place for the patient's body when the patient is lying on the device.

A pair of post members 40 are disposed in upright positions at one end of the base. Each post member has an upper section 42 and a lower section 43, wherein the two sections are coupled together in a telescoped arrangement. The upper section 42 has a rodlike shape, and the lower section 43 has a rectangular bar shape having a cylindrical bore 44 along its length direction, for slidably receiving the upper section. This configuration allows the manual adjustment of the height of the post members. A locking screw mechanism 50 is incorporated that can be loosened to adjust the height and tightened to maintain the selected height.

In the mode of the invention shown, the mutual spacing between the post members 40 may be varied by use of a hand-operated, screw-driven adjustment mechanism. The lower end portion 46 of each post member has a threaded hole, for receiving and engaging a guiding rod 60 which has threads 65 that are appropriately directioned. The cranking by hand of a handle or knob 70 widens or narrows the mutual spacing. As depicted in the top plan view of FIG. 3, the base has grooves 80 into which the lower end portions 46 are slidably received, for guiding these horizontal adjustments of the post members. Other means of adjusting the spacing or height of the posts, as known in the art, may also be used.

Each upper section 42 of the post members has disposed thereon a screw or pin 90, for having hooked thereon an end of a compliant strap 100, so that this strap is extended between the post members 40. In the embodiment of the invention shown, a chain 105 is used for this strap, having a flexible elongated tube (not shown in FIGS. 1–3) disposed therearound for comfortably supporting a neck area of a patient. Other possible constructions of this element known in the art, such as a strap comprising a polymer or other suitable material, are also anticipated herein.

Figure 4:
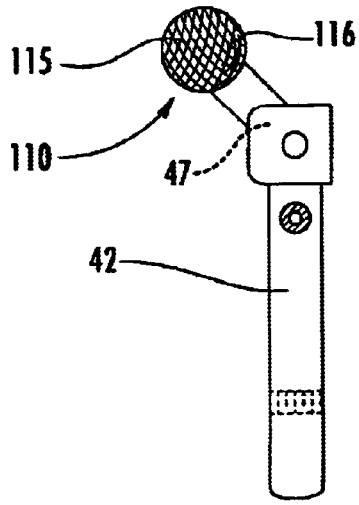
FIG. 4 is a fragmentary, side elevational view of each of the contact and post member elements of the device illustrated in FIGS. 1–3.

A contact element 110 is positioned rotatably at the upper end portion 47 of each post member. As illustrated in FIG. 4, each contact element 110 has a generally rounded contact end 115 and includes a surface comprising a soft, pliable material, such as a rubber coating 116, for supporting an upper cervical region of a patient.

Figure 5:
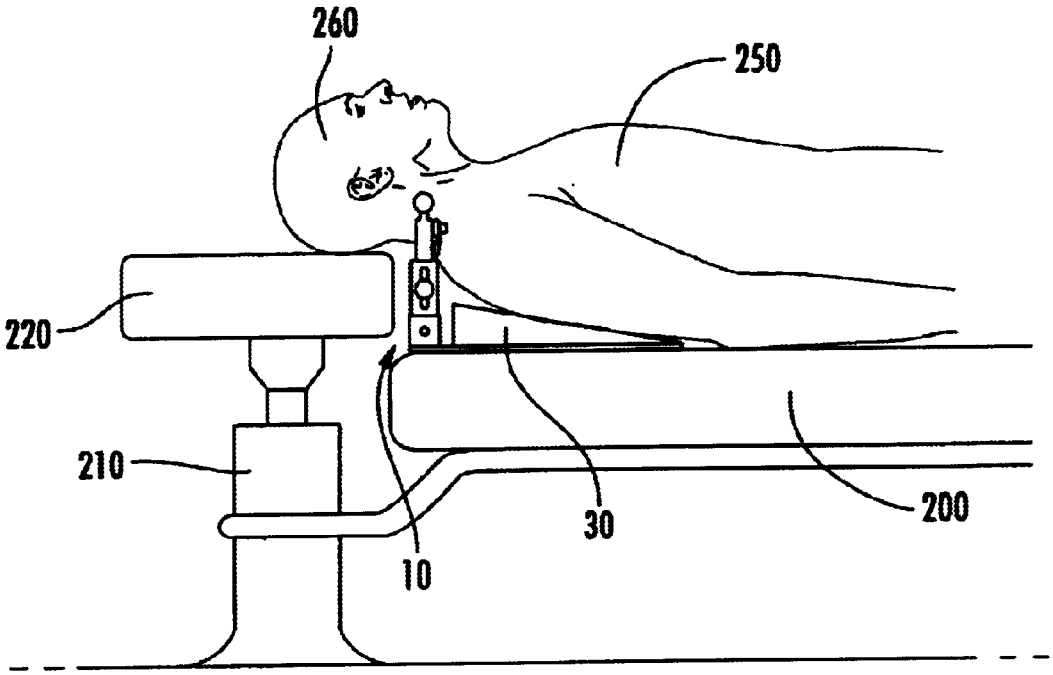
FIG. 5 is a side elevational view of a patient utilizing the invention in one mode of usage.
Figure 6:
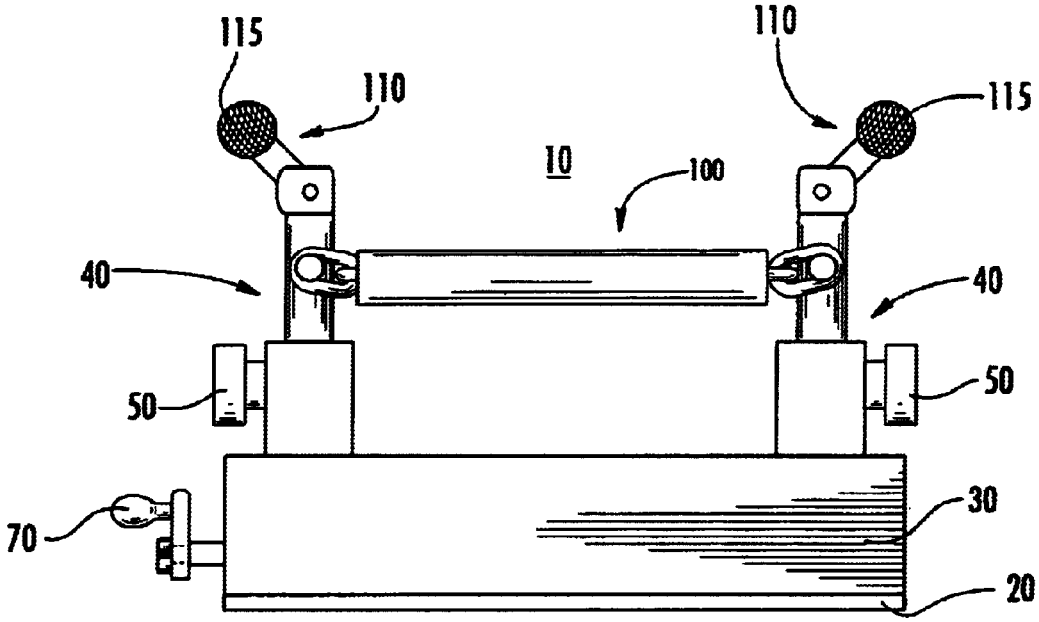
FIG. 6 is a front elevational view of the device in a first mode.

As illustrated in FIG. 5, the device 10 is placed on a chiropractic table 200 in use, and the individual to be treated 250 lies in a supine position on the device 10. In one application of the device, the contact elements 110 are rotated, or flipped, outwardly and the post members 40 are spaced apart so that the strap 100 is extended to a substantially horizontal position. This configuration, depicted in FIG. 6, is designated to be a first mode of the instrument.

The device in this manner is typically used together with a chiropractic drop table designated as 210 in FIG. 5, having a headpiece 220 that can drop when pushed down, and which has a cocking mechanism (not shown). The patient 250 lies in a supine position on the chiropractic table 200 and rests his head 260 on the raised, cocked headpiece 220.

Figure 7:
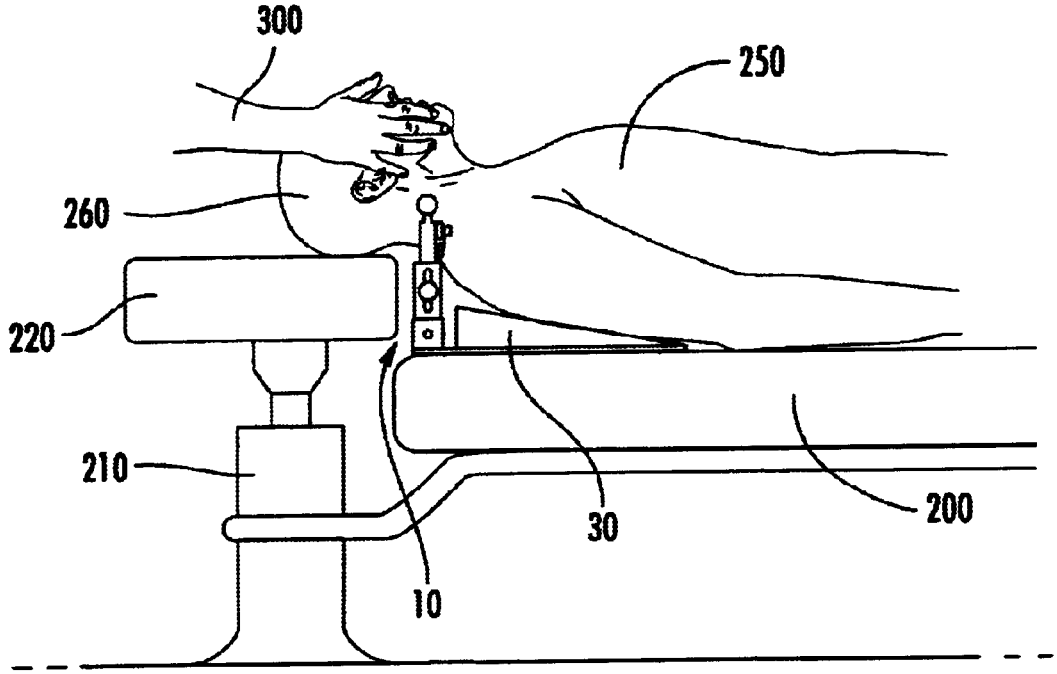
FIG. 7 shows the mode of usage illustrated in FIG. 5, depicting the positioning upon completion of the chiropractic procedure.

This mode of usage allows the treatment of injuries affecting the C3 to C6 vertebrae. The patient can slide up or down on the cushion 30 until the appropriate affected area rests in extension on the strap 100, so that the affected vertebra or joint is isolated on the strap. As shown in FIG. 7, the doctor then places his hands 300 on the forehead region of the patient and applies a light downward thrust. This gentle application of force causes both the headpiece 220 and the head 260 to drop downward about a fraction of an inch.

This procedure corrects the vertebral malalignment and allows the healing of associated ligament problems. By isolating the affected area on the strap 100 and using that as a fulcrum or pivot point for the procedure, the device permits a more specific adjustment as compared with conventional techniques done only by hand. The instrument applies a specific force to that area, allowing the doctor to be more precise and to deliver lighter forces to unlock the vertebrae. When the patient rests on the instrument, it also helps to re-align damaged ligaments or correct ligament laxity, allowing the doctor to focus primarily on re-aligning the bones.

Figure 8:
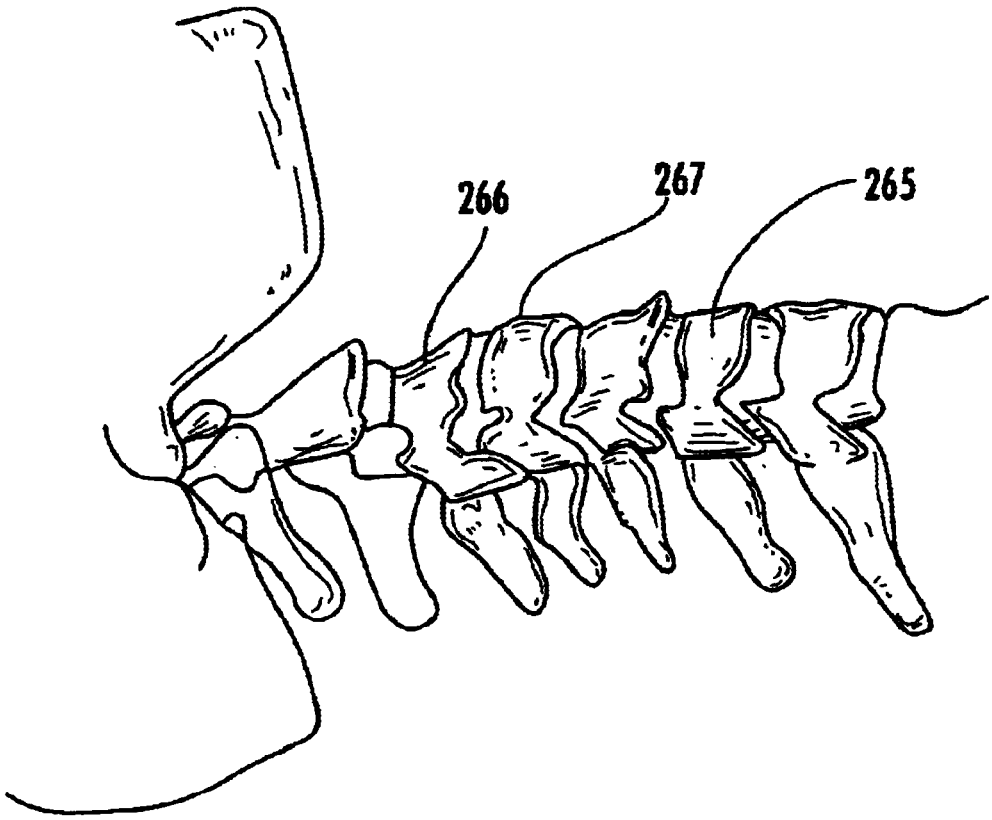
FIG. 8 illustrates how the device may operate on a cervical spine.

Essentially, by applying pressures in certain affected regions, the device allows for a more specific adjustment. As an example, FIG. 8 illustrates a cervical spine 265 exhibiting listhesis, where the third cervical 266 is abnormally positioned behind the fourth cervical 267 vertebra. In such cases, the patient can rest on the instrument so that it applies a force, indicated by the arrow, to the posteriorly positioned vertebra, permitting the doctor to deliver a more precise and lighter force to re-align the bones. Performing such a technique only by hand requires the doctor to work on a greater treatment area. Thus, the device allows for more precise, lighter, and consequently safer, adjustments.

Figure 9:
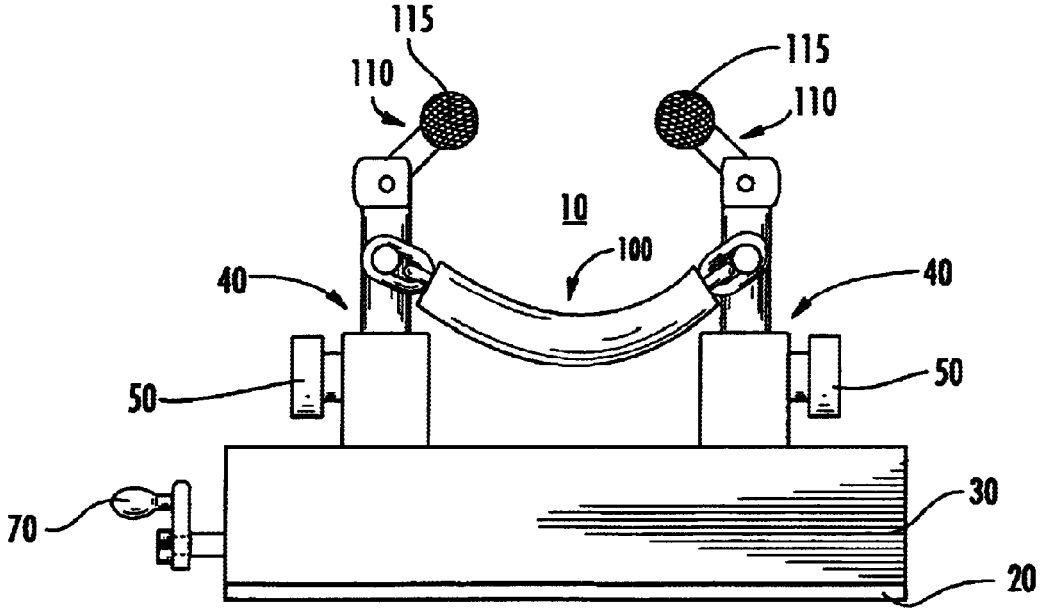
FIG. 9 is a front elevational view of the device in a second mode.
Figure 10:
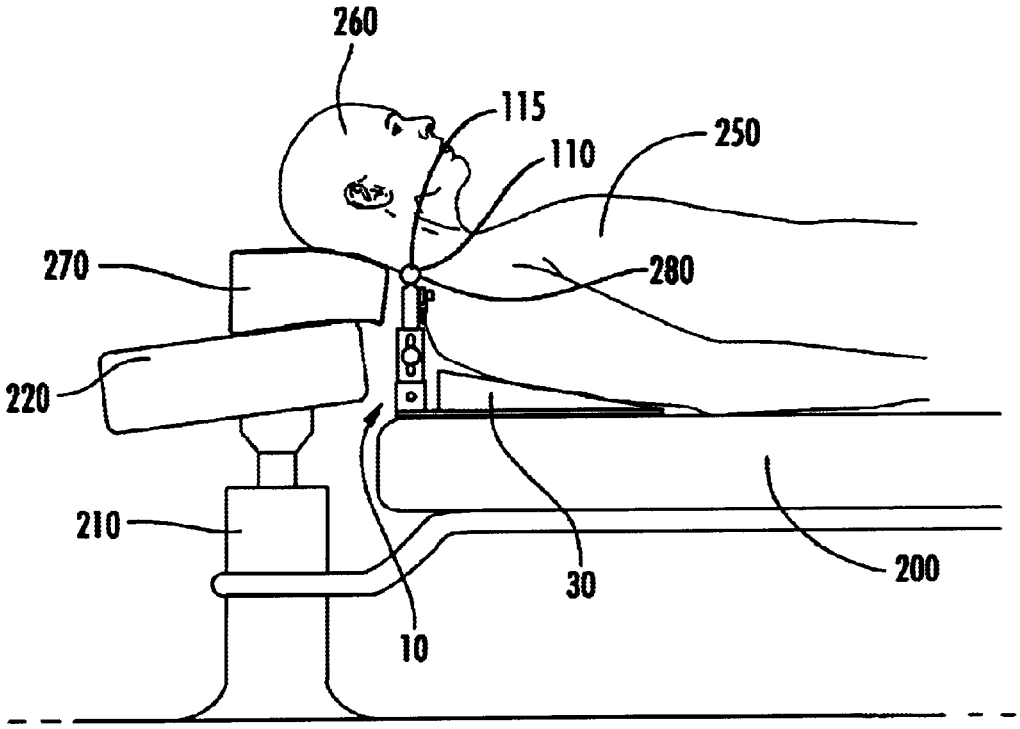
FIG. 10 is a side elevational view of a patient utilizing the invention in another mode of usage.
Figure 11:
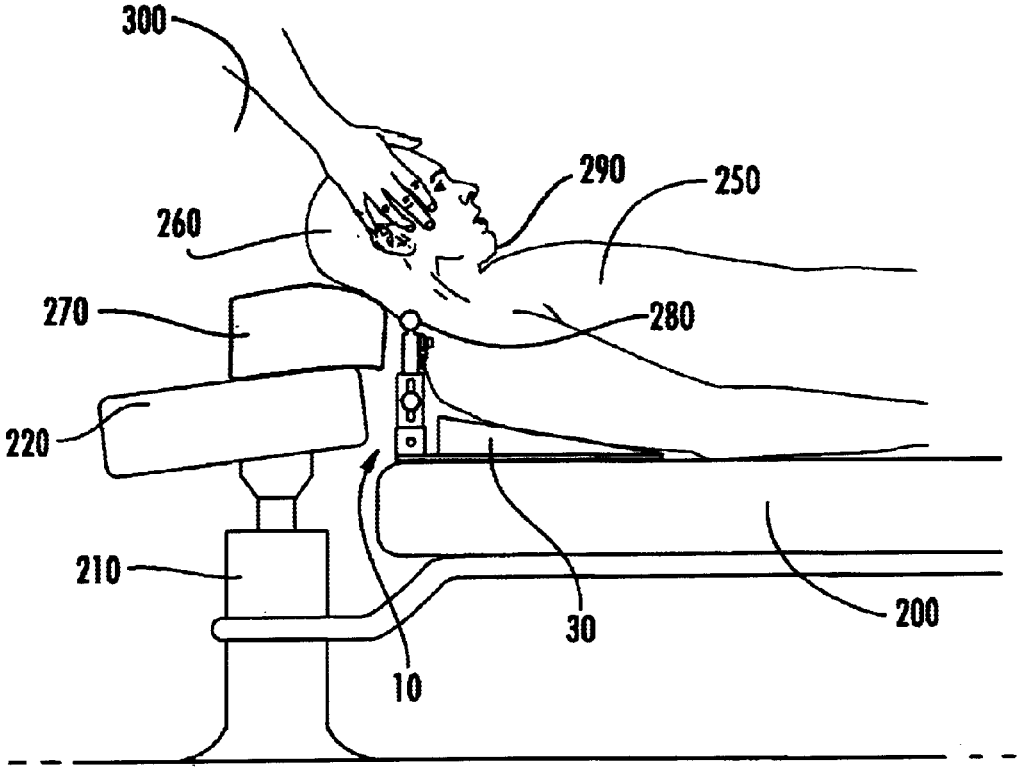
FIG. 11 shows the mode of usage illustrated in FIG. 10, upon completion of the chiropractic procedure.

In another mode of operation of the device, as illustrated in FIGS. 9–11, the contact elements 110 are flipped inwardly, or medially, and the post members 40 are moved closer together to support the atlas of the patient. This configuration, depicted in FIG. 9, is designated to be a second mode of the device, and can be used for correcting problems in the C0/C1 joint.

Referring to FIG. 10, the patient 250 lies again in a supine position on the chiropractic table 200. The drop mechanism of the headpiece 220 is not necessary for this mode of usage; the patient simply rests his extended head on the raised headpiece 220 during the procedure. A pillow 270 may be positioned to support the patient's head, if the headpiece does not rise high enough for this procedure. The contact elements 110 are approximated so that the rounded ends 115 support the patients' extended upper cervical region, right behind the mastoid process, by bilaterally hooking into the region of the arch of the patient's atlas 280. As shown in FIG. 11, the doctor then places his hand 300 on the upper and frontal regions of the patient's head 260 and delivers light, pumping forces directing the patient's chin 290 into the chest. These repeated, adjustive thrusts cause the head 260 to bend forward and flex the affected C0 vertebra on the C1. This technique can correct flexion problems of the C0/C1 joint and restore proper flexion biomechanics of the cervical spine in that area. Again, the instrument allows the doctor to deliver more precise adjustive thrusts by reducing the area to be manipulated.

The subject invention thus provides a highly simple and convenient means of facilitating the correction of various serious and common neck problems. As mentioned above, typical vertebral malalignments that can be corrected with the above techniques include fixation, reverse cervical curve or retro/antero listhesis of the C3–C6 vertebrae and flexion problems related to the C0/C1 joint. The use of various other procedures and the correction of injuries resulting from other types of accidents, such as those relating to gymnastics or the use of trampolines, are also contemplated within the scope of the invention. The device may be also be useful for spinal abnormalities relating to other causes, such as joint arthritis.

As described above, the device is also relatively compact in size and is portable, so that it can be used with any chiropractic table, as needed. It is not necessary to build these mechanisms into the tables during their manufacture.

Thus, relatively few units would need to be produced or purchased to meet the needs of chiropractic practitioners. The instrument is also conveniently adjustable for the optimal positioning of the post elements with respect to each individual patient. Thus, the present invention provides a portable, highly simple, easy to use and versatile device for facilitating and improving on various adjustive techniques, which can result in safer procedures.

The foregoing description of the embodiments of this invention has been presented for purposes of illustration and description. It is not intended to be exhaustive or to limit the embodiments of the invention to the form disclosed, and, obviously, many modifications and variations are possible. As an example, the positioning of the strap and contact elements may be varied for the two modes or other possible modes, and such modes may facilitate adjustments of regions other than those mentioned above. Additionally, supporting means other than the strap or contact elements as known in the art may be used, or the device may incorporate more than two post members. Such modifications and variations that may be apparent to a person skilled in the art are intended to be included within the scope of this invention as defined by the accompanying claims.

What is claimed is:

1. A chiropractic adjusting device for facilitating adjustments of the skull and cervical regions of a patient, comprising:

a base having relatively parallel post members spaced apart and being capable of moving on said base to adjust the spacing between the members, said post members being capable of being positioned in a first mode and a second mode;

a compliant strap extending between said post members, for supporting said regions of the patient, said strap having first and second ends coupled to said post members; and contact elements positioned rotatably on said post members, for supporting said regions of the patient;

wherein in said first mode, said post members support a cervical region for facilitating the chiropractic adjustment of the cervical region; and wherein in said second mode, the post members support an upper cervical region for facilitating the chiropractic adjustment of the skull region.

2. The device of claim 1, wherein said contact elements comprise a pliable contact surface.

3. The device of claim 1, further comprising a means for varying the spacing between the post members.

4. The device of claim 1, further comprising a means for varying the heights of the post members.

5. A chiropractic adjusting device for facilitating adjustments of the skull and cervical regions of a patient, comprising:

a base having relatively parallel post members spaced apart and being capable of moving on said base to adjust the spacing between the members, said post members being capable of being positioned in a first mode and a second mode;

wherein in said first mode, a compliant strap extending between said post members and having first and second ends coupled to said post members, support a cervical region for facilitating the chiropractic adjustment of the cervical region; and wherein in said second mode, contact elements positioned rotatably on said post members support an upper cervical region for facilitating the chiropractic adjustment of the skull region.

6. The device of claim 5, wherein said contact elements comprise a pliable contact surface.

7. The device of claim 5, further comprising a means for varying the spacing between the post members.

8. The device of claim 5, further comprising a means for varying the heights of the post members.

9. A method of facilitating chiropractic adjustments of the skull and cervical regions of a patient, the method comprising:

providing a device comprising a base and a compliant strap, said base having relatively parallel post members spaced apart and being capable of moving on said base to adjust the spacing between the members, said compliant strap extending between said post members and having first and second ends coupled to said post members; said device further comprising contact elements positioned rotatably on said post members, for supporting said regions of the patient;

supporting a cervical region of the patient; and performing a chiropractic adjustment on said region.

10. The method of claim 9, wherein said region to be adjusted includes at least one of the C3 to C6 vertebrae or the C0/C1 joint.

* * * * *